US006928965B2

(12) United States Patent
Teufl

(10) Patent No.: US 6,928,965 B2
(45) Date of Patent: Aug. 16, 2005

(54) RECIPROCATING PISTON ENGINE COMPRISING A ROTATIVE CYLINDER

(76) Inventor: Erich Teufl, Sommerstrasse 4 a, 85586 Poing (DE)

( * ) Notice: Subject to any disclaimer, the term of this patent is extended or adjusted under 35 U.S.C. 154(b) by 0 days.

(21) Appl. No.: 10/489,729

(22) PCT Filed: Sep. 11, 2002

(86) PCT No.: PCT/EP02/10196

§ 371 (c)(1),
(2), (4) Date: May 26, 2004

(87) PCT Pub. No.: WO03/025369

PCT Pub. Date: Mar. 27, 2003

(65) Prior Publication Data

US 2004/0216702 A1 Nov. 4, 2004

(30) Foreign Application Priority Data

Sep. 14, 2001 (DE) ..... 101 45 478

(51) Int. Cl.[7] ..... F02B 57/00; F02B 53/00

(52) U.S. Cl. ..... 123/43 R; 123/43 C; 123/18 R; 123/44 E

(58) Field of Search ..... 123/43 C, 43 R, 123/44 R, 44 D, 44 E, 18 R

(56) References Cited

U.S. PATENT DOCUMENTS 897,260 A * 8/1908 Luther, Jr. ..... 123/44 E
1,285,835 A * 11/1918 Sunderman ..... 123/43 R
1,918,174 A * 7/1933 Berggren ..... 123/18 R
1,990,660 A 2/1935 McCann ..... 123/43 C
2,154,370 A * 4/1939 Wolf ..... 123/43 R
2,886,017 A * 5/1959 Dib ..... 123/43 R
3,572,209 A * 3/1971 Aldridge et al. ..... 123/44 E
3,841,279 A 10/1974 Burns ..... 123/43 C
6,705,202 B2 * 3/2004 Harcourt et al. ..... 123/43 C

FOREIGN PATENT DOCUMENTS

FR 1 388 660 2/1965
FR 1 422 339 12/1965
WO WO 8301091 A1 * 3/1983 ..... 123/43 C

* cited by examiner

*Primary Examiner*—Thai-Ba Trieu
(74) *Attorney, Agent, or Firm*—Jordan and Hamburg LLP

(57) ABSTRACT

A reciprocating piston engine includes a rotor housing for transferring torque to an engine output drive; a contoured guide element in the rotor housing, having a closed, curvilinearly contoured shape, around which the rotor housing is rotatable; at least one compression unit in the rotor housing, each unit including a piston and a cylinder, with the piston having a straight line of action in a plane perpendicular to the axis of rotation of the rotor housing; a connecting rod, rigidly coupled to the piston, movable along a path determined by the contoured guide element, for transferring controlled movement specified by the contoured guide element to the piston; and a guide part, joined to the connecting rod, and movable along a separate guide in the rotor housing, with the connecting rod, the piston, and the guide part each performing a single stroke along a straight line in the rotor housing.

15 Claims, 7 Drawing Sheets

RECIPROCATING PISTON ENGINE COMPRISING A ROTATIVE CYLINDER

BACKGROUND OF THE INVENTION

The present invention relates to a reciprocating piston engine with rotating cylinder for generating torque. The reciprocating piston engine preferably works as a combustion engine; however, with various minor structural variations and arrangements of the control channels it can also be used in areas of hydraulics. Specifically, it can be used for hydraulic pumps, overpressure pump, and vacuum pumps.

The best known representative of a rotary piston engine in the field of combustion engines is the Wankel engine. It has a moving trochoidal piston that forms a working chamber. The piston moves by means of internal gears and eccentric bearing of the engine shaft in the interior space of an epitrochoid. The corners and lateral surfaces of the piston have sealing elements. Gas exchange occurs by opening and closing slits in a housing enclosing the piston. The Wankel engine is characterized by its total mechanical balance, its compact construction due to the lack of a valve train. However, disadvantages are the low torque and the unfavorable combustion chamber geometry with long combustion paths, resultant high hydrocarbon emissions, and higher fuel and oil consumption and higher manufacturing costs compared to other reciprocating piston engines. In addition, due to the working principle there is not a direct opportunity for realizing a diesel engine with the Wankel principle.

SUMMARY OF THE INVENTION

The object of the present invention is to create a reciprocating piston engine whose overall efficiency is increased relative to that of reciprocating piston engines in prior art, whose mass/performance ratio is improved, whose control is structurally simplified, whose production and assembly is less complex, whose smooth running is optimized, and whose pollutant emissions are reduced.

This object is achieved with a reciprocating piston engine that includes a rotor housing for transferring torque to an engine output drive; a contoured guide element in the rotor housing, having a closed, curvilinearly contoured shape, around which the rotor housing is rotatable; at least one compression unit in the rotor housing, each unit including a piston and a cylinder, with the piston having a straight line of action in a plane perpendicular to the axis of rotation of the rotor housing; a connecting rod, rigidly coupled to the piston, movable along a path determined by the contoured guide element, for transferring controlled movement specified by the contoured guide element to the piston; and a guide part, joined to the connecting rod, and movable along a separate guide in the rotor housing, with the connecting rod, the piston, and the guide part each performing a single stroke along a straight line in the rotor housing. Additional embodiments having further advantages are also disclosed.

A reciprocating piston engine with rotating cylinders has at least one compression unit that is arranged in a rotor housing, whereby in an internal area of the rotor housing there is a space that has a contoured guide element about which the piston is arranged such that it can move 360° in the rotatable rotor housing, whereby the piston is coupled to the contoured guide element such that the contoured guide element effects a stroke of the piston during the movement of the cylinder unit about the contoured guide element. This construction of the reciprocating piston engine creates a completely new principle. While in the past with the conventional reciprocating piston engines the cylinder housing was fixed and the reciprocating pistons conveyed torque via a rotating crankshaft, in the present case the piston is arranged such that with the rotor housing it can rotate 360°about a contoured guide element. In addition this makes possible combustion of a combustible medium in a combustion chamber such that pressure builds on the piston. The pressure on the piston is also applied to the rotor housing. Since it is arranged rotatable about the contoured guide element and the piston is coupled to the contoured guide element, torque occurs about the contoured guide element, which leads to a rotary movement of the rotor housing about the contoured guide element. At the same time, the coupling of the contoured guide element and the piston controls the stroke of the piston. This control realizes the cycles of the reciprocating piston engine such as induction, compression, combustion, and exhaust. The 4-cycle principle is preferably applied. However, with a suitable design it is also possible to apply the 2-cycle method. The torque generated depends especially on how many pistons are arranged in the rotor housing. This can be made dependent on the size of the rotor, and vibrations that occur can also be taken into consideration. In particular a plurality of rotor housings can be coupled to one another (in the manner of a radial engine) so that the result is a series of pistons situated one after the other that with the rotor housing are movable about a contoured guide element. Preferably one rotor housing has three, four, or more pistons.

Thus, in accordance with the invention the line of action of the piston of a compression unit (piston stroke direction) is arranged in a plane and lies perpendicular to the axis of rotation of the rotor such that the line of action runs in a straight line and eccentric to the axis of rotation of the rotor.

Preferably the contoured guide element is designed such that during a cycle a combustion chamber limited by the piston is largely isochoric, that is, it has a constant volume. The combustion chamber does not change over a certain period of time of the cycle. This achieves particularly high torque generation about the contoured guide element since the combustion chamber itself remains largely constant. In contrast to a different reciprocating piston engine, this results in complete combustion of the combustion gas in the combustion chamber, and also the temperature that occurs during combustion, and thus the increase in pressure in the combustion chamber, can be taken advantage of for a long time. Such a period of an isochoric combustion chamber is adjusted using the rotational speed. Another deciding factor is the length of the cycle. This is preferably at least 90°, however in particular it is through a 100° rotation about the contoured guide element. In a corresponding adaptation of the exhaust of the combusted gas, it is possible for a largely isochoric combustion chamber to be realized through approximately 120° and more.

Preferably a rotor has four compression units each including a piston and corresponding cylinder that are arranged offset to one another by 90°. It is possible during the cycle for the piston to perform one stroke due to the geometry of the contoured guide element, which is preferably closed. This especially makes sense when the intent is to ensure improved flow, and thus combustion, in the combustion chamber. The stroke that is controlled by the contoured guide element is preferably such that an induction stroke is clearly longer than an exhaust stroke. Preferably the contoured guide element for this reciprocating piston engine has a path shape that has a first, a second, a third, and a fourth segment, all of which are convex, concave, or linear. Each stroke cycle of the piston is thus uniform. In particular the segments are connected to one another such that largely uniform (negative or positive) acceleration of the piston is produced so that material load is kept low. In particular in the area of the reversal points the contoured guide element is designed such that compressive loads that occur due to the coupling of piston and contoured guide element remain as low as possible. One embodiment of the contoured guide element provides that this is realized in a cam disk. The cam disk has a slot. The slot is designed such that it provides the contoured guide element along which the piston travels according to the coupling. Preferably the contoured guide element/curve guide is embodied such that they perform at least one cycle during one complete rotation of the cylinder units.

Preferably the reciprocating piston engine has an eccentric disk and a first and a second cam disk. The two cam disks are arranged opposite the eccentric disk and each has a congruent contoured guide element. Between the two cam disks and the eccentric disk a connecting rod of the piston is guided into the slot via a corresponding guide. The controlled movement provided by the contoured guide element via the connecting rod is transferred to the piston, which completes its stroke along the cylinder chamber and its guide.

The piston is preferably guided via a needle-borne spacer shaft in the fixed cam mechanism. The spacer shaft is preferably a single piece, for instance cast or forged. In one further design, however, it is made of individual components that have been combined into a whole. The cam mechanism is formed by the two cam disks and the eccentric disk. Offsetting the two flanks of the slot curve provides play-free guidance for the piston. Each flank has its own roller that is situated on the spacer shaft. The rollers run therethrough in opposing rotational directions and are constantly held in place.

One further development of the reciprocating piston engine provides that a guide part that is arranged on the piston is separated from the piston by a sealing part. The sealing part and the guide part are coupled to the piston and are rotatably carried with it. The rotatably carried coupling transfers the force acting on the piston to the rotor housing. The guide part is movably arranged along a separate guide in the rotor housing. The guide part is preferably disposed at least in part in the rotor housing. The sealing part, for instance formed via the piston with its piston rings and the connecting rod connected thereto, thus forms a first arm, while the guide part forms a second arm separated therefrom. These two arms are preferably connected to one another again at a connecting rod bearing. Thus the sealing and guide part form a lever system. It is preferred that the lever arm of the guide part is shorter than the lever arm of the sealing part. In this manner it is possible to obtain particularly high torque generation on the rotor housing via the connecting rod bearing, to which preferably both arms are attached. In particular the piston with sealing part and guide part is matched to the contoured guide element such that the guide part and the sealing part can each perform one stroke along a straight line in the rotor housing. This means that in particular the guide part ensures that the pressure force acting on the piston is transferred to the rotor housing. One stroke of the guide part is then preferably performed by means of a bearing, in particular a rolling bearing. This is in particular designed such that it is in a position to be able to transfer continuously a pressure force from the guide part to the rotor housing. The sealing and guide part thus form a lever system for transferring a pressure force acting on the piston via the guide part to the rotor housing. The piston with the sealing part and the guide part can be made of one piece, for instance cast or forged. In a further embodiment, however, these are made of individual components that have been combined into a whole. The axis of the guide part perpendicularly intersects the axis of rotation of the rotor.

The piston limiting the combustion chamber is preferably designed such that a mixture rotation is supported in the combustion chamber during the induction process. This occurs for instance using a conical piston head arranged approximately central symmetrically that amplifies swirling by creating a circular squeeze zone. Preferably an inlet angular momentum is obtained for producing swirling in the combustion space by means of angular admission into the combustion chamber. For this, an admission aperture is arranged inclined to the longitudinal axis of the piston (stroke axis), for instance.

Furthermore the reciprocating piston engine has a rotor housing that has a rotationally symmetrical exterior cover. First, this has the advantage that an imbalance on the rotor housing is avoided thereby. This is why it is also preferred that corresponding components of the reciprocating piston engine oppose one another and are thus arranged in pairs in order to avoid corresponding unbalance torque at high rotational speeds, for instance from 5000 to 8000 $min^{-1}$, in particular of 12000 $min^{-1}$ (revolutions per minute). Preferably desired is an arrangement of the components such that the forces that are generated based on the rotation of the rotor housing compensate one another. Also, a rotationally symmetrical exterior cover makes it possible for gas supply and gas discharge in the combustion chambers in the rotor housing to be designed particularly gas tight. One embodiment of the reciprocating piston engine has on the exterior cover of the rotor housing a rotating gas exchange/sealing system, the surface of which radially closes with, that is, is sealingly adjacent to, the exterior cover of the rotor housing. If the rotor housing is arranged in a cover housing, the rotatably carried gas exchange/sealing system is in a position to produce a seal between the cover housing and the rotor housing.

The rotor housing is preferably arranged in a cover housing that has at least a concave surface that is arranged opposing an exterior cover of the rotor housing. The gas exchange/sealing system is designed such that the combustion chamber(s) in the rotor housing are correspondingly sealed during each of the cycles/phases: induction, compression, combustion, and exhaustion. In addition, the sealing system ensures the most complete possible filling/evacuation of the combustion chamber via a corresponding supply/discharge of the inflowing and outflowing gas. For this, for instance arranged in the cover housing, are corresponding control channels or corresponding apertures along which the combustion chamber is filled and discharged. The control channels can be arranged along the surface opposing the exterior cover of the rotor housing or even lateral thereto along the side surface of the rotor housing. This is also true for the gas exchange/sealing system. Due to the rotating gas exchange/sealing system, the control channels, preferably in the form of slits, can be relatively long, for instance they can extend across a 10° to 30° angle of rotation via discharge channel or for instance up to 120° angle of rotation via inlet channel or more; the inlet channel is preferably substantially longer than the discharge channel. The depth and the width of the control channels and the distance between the control channels depends on the size of the reciprocating piston engine. The control channels can be appropriately adapted to the inflow conditions and to the respective pressures during inflow and outflow.

Preferably the gas exchange/sealing system has a radially movable and preferably rotatable slide element that is under pressure that is attached eccentrically on the exterior cover of the rotor housing. This slide element is for instance held in a slot that is arranged eccentrically on the exterior cover of the rotor housing. The slide element, which is preferably roller-borne, seals the rotor chamber against the opposing cover chamber. For this, the roller-borne sliding ring preferably also has a surface corresponding to that of the opposing cover housing. This is preferably spherical. In addition, the sliding ring has at least one sealing lip, preferably two sealing lips. The sealing lip touches the cover housing and thereby triggers a sealing effect. In this manner it is ensured that the system is leak-tight, even if there is an overflow of an ignition channel with a spark plug arranged therein. When for instance two sealing lips are arranged on a circular sliding ring, the first sealing lip encloses the second sealing lip. Both sealing lips are arranged circular in one another. The sliding ring also preferably performs an axial movement in addition to the radial movement. The axial movement is an axial rotational movement. For this, the sliding ring is attached eccentrically and is arranged with respect to the surface of the cover housing such that the latter produces a rotational movement on the sliding ring. The rotational movement has the advantage for instance that, due to it, any foreign bodies present are transported out due to the radial force and are thus removed from the path of travel.

In order to be able to reduce the torque on the rotor housing, an output drive is preferably flange-mounted to the rotor housing. This is done for instance by means of a speed-transforming gear, preferably by means of a planetary gear. This makes it possible to increase the number of rotations and also to decrease the number of rotations. Particularly smooth running can be obtained when, in addition to the reciprocating piston engine, at least one additional reciprocating piston engine is additionally arranged in a multiple arrangement one after the other on one shaft. For instance this makes it possible for a first reciprocating piston engine to be offset 180° from a second reciprocating piston engine with respect to the phase of the cycle segment. This improves running smoothness when there is simultaneous ignition of the first and second reciprocating piston engines. One further embodiment provides that a plurality of reciprocating piston engines present in multiple arrangement on one shaft or separate from one another can each be turned on and off individually. It is also possible for ignition of a reciprocating piston engine to be triggered for one cylinder. This is possible for instance when using the reciprocating piston engine when decelerating to save fuel, as is known for motor vehicles. Another embodiment again has modifiable inlet and outlet apertures for the inflow and outflow of the medium to be ignited and for any air to be supplied. This modification is possible for instance by means of a throttle cross-section. The throttle cross-section is preferably controlled or regulated by means of an engine control unit corresponding to the required output.

For ensuring the most frictionless possible running of pistons and other movable components, the reciprocating piston engine has a lubricating system that is independent of the installation position of the reciprocating piston engine, that is, it is position insensitive. The lubricating system is embodied as position-insensitive circulating forced-oil lubrication. The oil is drawn in from the oil ring by the annular gear pump. A pressure relief valve within the pump housing limits the oil pressure and conducts the excess oil back into the intake channel of the pump. From the pressure channel the oil is conducted through the oil filter to the oil force-feed nozzles. From there, the lubricating oil travels into the rotor housing. The rotor housing has a plurality of rotatably carried lubricating channels. These distribute the lubricating oil to the lubrication points. Due to centrifugal forces, the lubricating medium, generally oil, is pressed outward so that preferably the moving components are lubricated from the interior of the rotor housing outward. In this manner it is possible to take advantage of the rotational speed of the reciprocating piston engine in another manner.

The oil is returned via the rotor housing, which has a plurality of rotatably carried spin channels. The centrifugal force presses the lubricating oil out through the spin channels. The oil is thrown against the opposing oil ring aperture, drips down, and travels into the closed part of the oil ring. There it is fed back into the lubrication cycle. This process is repeated continuously in order to assure reliable position-insensitive lubrication. Preferably the oil ring can be rotated 360°, is roller-borne, and is arranged on the front of the cover housing. Two sealing rings seal the oil ring to the intake channel; these are securely joined to the cover housing. Sealing of the side opposing the intake channel is performed by a sealing ring, axially movable and provided with a compression spring, that continuously holds the oil ring in place. The cover housing has apertures on the circumference through which the thrown oil travels into the oil ring aperture. The oil ring is divided into two parts, whereby a first oil ring housing is joined to a second oil ring end housing. However, the oil ring can also comprise one part, for instance a cast part. A float needle valve is arranged in the oil ring, whereby the float needle valve and the oil return bores located in the cover housing return the excess oil to the lubrication cycle. The volume content of the closed part of the oil ring should be less than, but no more than equal to, the volume content of half of the oil ring aperture. This avoids unnecessary excess oil and minimizes losses of all types. Inspection windows for checking the oil level are attached to the oil ring and to the oil ring cover; the windows have markings. The oil level itself is regulated by an oil fill plug and a drain plug arranged in the oil ring.

The reciprocating piston engine in accordance with the invention makes it possible to convert energy contained in a combustible medium into mechanical energy. Through combustion, the medium releases energy in the combustion chamber in which a movable piston is arranged, via which piston the pressure energy occurring from combustion is converted to mechanical energy. The pressure energy produces torque about a fixed axis, which leads to rotation of a combustion space with the combustion chamber and the piston about the fixed axis, whereby mechanical energy is removed via this rotation. This principle has the advantage that it can take advantage of a circular motion or acceleration with a long lever arm, whereby high torques occur about the fixed axis.

The following drawings illustrate one exemplary embodiment of a reciprocating piston engine in accordance with the invention. These explain in detail how the energy contained in a combustible medium is converted into mechanical energy by means of the inventive reciprocating piston engine.

DESCRIPTION OF THE EMBODIMENTS

Figure 1:
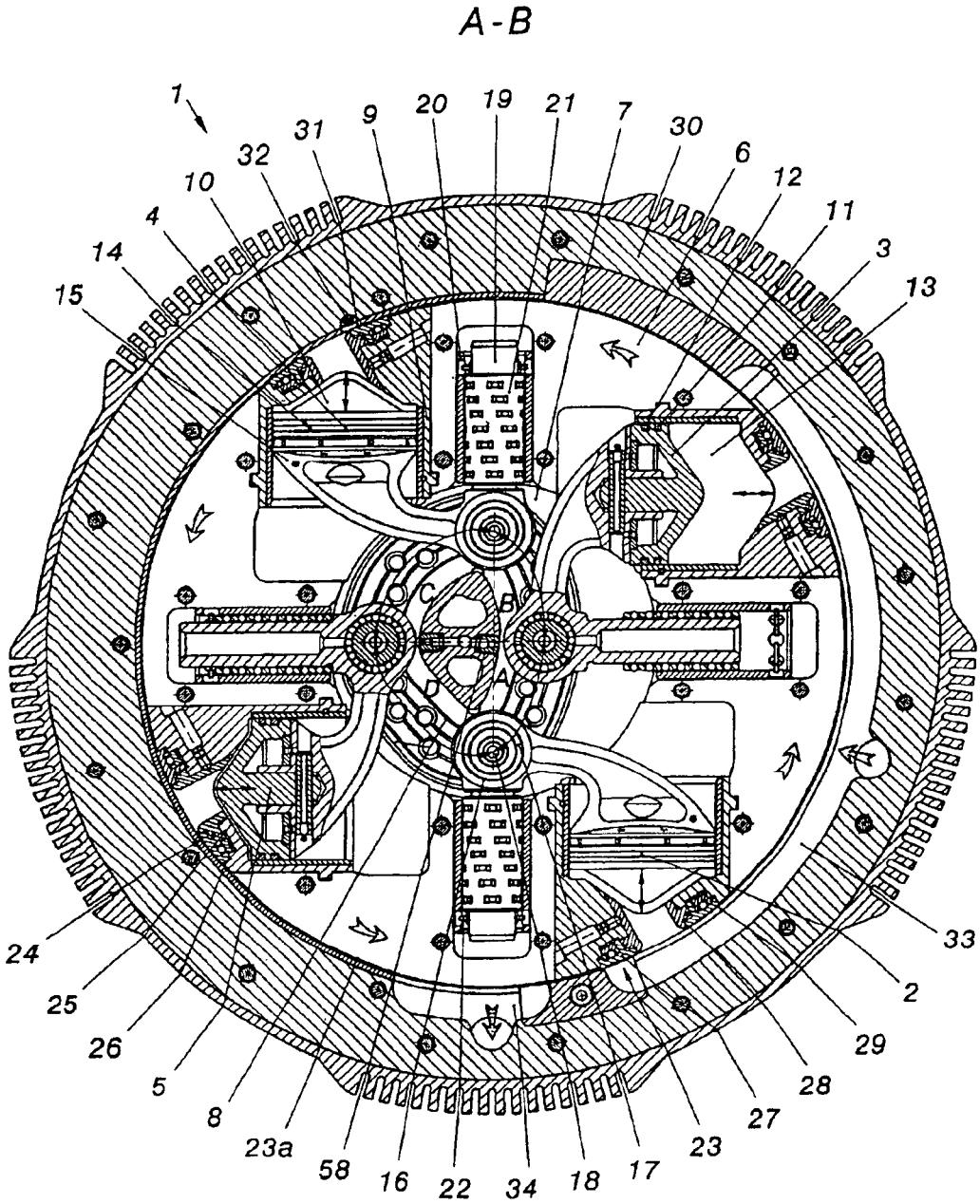
FIG. 1 is a front elevation of a section of a reciprocating piston engine (section AB in accordance with FIG. 2)

FIG. 1 illustrates a reciprocating piston engine 1. It has a first piston 2, a second piston 3, a third piston 4, and a fourth piston 5. The pistons 2, 3, 4, 5 are each arranged offset 90° in a rotor housing 6 of the reciprocating piston engine 1. A space 7 is in the interior area of the rotor housing 6. A curved guide or contoured guide element 8 is arranged in the space 7. The pistons 2, 3, 4, 5 each perform one stroke, indicated by a double arrow. The piston 2, 3, 4, 5 runs along a straight first guide 9. The first guide 9 is employed for the cylinder unit in the rotor housing 6. The piston 2, 3, 4, 5 has a piston head with a conical top 10 that is arranged central-symmetrically (centrically). The top 10 forms part of the combustion chamber geometry. The illustrated conical shape of the top 10 takes advantage of the angular momentum of the inflowing fuel/air mixture in the induction process in order to obtain better swirling and thus better mixing in the combustion space. This improves the subsequent combustion. For shaping the combustion chamber, the conical top 10 can also be replaced by another top, whereby its geometry depends for instance on how the medium to be burned, that is, the fuel, is supplied. For instance, different injection methods can be used that are typical for an Otto engine or diesel engine. Among these are injection methods without air swirling with a 6- or 8-hole injection nozzle, as is known for slow-running large diesel engines. A 3- or 5-hole injection nozzle can also be used, whereby during direct injection the combustion air flowing to each of the pistons 2, 3, 4, 5, in the form of a swirling stream effects formation of a mixture given the appropriate shape of the inlet element. It is also possible to inject fuel onto the combustion chamber wall using an eccentrically arranged single-hole nozzle into a trough-shaped combustion chamber. In addition to direct injection methods, secondary chamber combustion methods such as for instance swirl chamber or precombustion chamber methods can be used. If the reciprocating piston engine 1 is designed appropriately, a charge stratification also works in which a ignitable mixture is produced at the spark plug by internal mixing, while a depleted mixture is present in the other area of the combustion chamber.

The reciprocating piston engine 1 can also be employed for a multifuel engine. Due to high compression of the reciprocating piston engine 1, which can be $\epsilon=14$ to $\epsilon=25$ and greater, it is possible to be able to process fuels of very different quality without damaging the engine. An internal mixture formation is used, for instance, in which for supporting ignition an additional fuel stream, injected directly into the combustion chamber, of 5–10% of the full fuel load quantity ensures firing. In this latter case, an external mixture formation can also be used. Thus, the reciprocating piston engine 1 can be used for a wide variety of fuels. These include alcohol or gas, especially hydrogen, in addition to conventional gasoline or diesel fuels. The components needed for the combustion process are arranged in a cover housing (not illustrated in greater detail) in which the rotor housing 6 is situated.

In addition to different combustion methods, the manner in which the reciprocating piston engine 1 works can also be supported by various supercharging methods. Suitable for this are pressure pulsation intake manifold supercharging, resonance charging, and switch-over flap supercharging systems, whose induction pipe length can be changed depending on number of rotations by opening or closing flaps. In addition to using these supercharging systems, which exploits the dynamics of the air inducted (fluctuation in the air column), mechanical supercharging systems such as for instance positive displacement superchargers can also be used in piston, vane, or Roots types. Exhaust gas turbocharging can also be used, whereby the exhaust gas turbine to be used can be switched on or off depending on the number of rotations of the reciprocating piston engine 1. In addition to exhaust gas turbocharging, pressure wave supercharging with a pressure wave supercharger is also possible. Appropriate supercharging is furthermore supported by the use of charge-air cooling for the reciprocating piston engine 1. In this manner it is possible to obtain even higher compression. A corresponding supercharging unit is connected for instance directly or indirectly to the rotor housing 6 in order to be able to use its rotation energy.

The piston 2, 3, 4, 5 illustrated in FIG. 1 furthermore has a first piston ring 11 and a second piston ring 12. Both piston rings 11, 12 seal a combustion chamber 13 from the space 7. In accordance with the illustrated embodiment, the second piston ring 12 also assumes the function of an oil scraper ring. The oil for lubricating the piston 2, 3, 4, 5 is caused to travel from the interior area of the space 7 outward to the first guide 9. Furthermore, the piston can have expansion-controlling inserts, so that different materials and thus different coefficients of expansion can be taken into account. For instance, the rotor housing 6 and the first guide 9 are made of aluminum.

Furthermore, it can be seen from FIG. 1 that the piston 2, 3, 4, 5 together with a connecting rod 15 forms a sealing part 14. The connecting rod 15 is joined directly to the piston 2, 3, 4, 5—both are rigidly coupled to one another. The design of the contoured guide element 8 permits the piston 2, 3, 4, 5 to be guided linearly. Thus, for instance, it is possible to do without a piston pin and its bearing in the connecting rod. The contoured guide element 8 also has a curved segment in order to provide a linear guide for the piston in the reciprocating piston engine 1 in conjunction with the coupling. Furthermore arranged on the connecting rod 15 is an aperture 16 for a connecting rod bearing 17, whereby the connecting rod bearing 17 receives a spacer shaft 18. The spacer shaft 18 connects the contoured guide element 8 to the connecting rod 15. The spacer shaft 18 is arranged eccentrically to the center of the piston 2, 3, 4, 5. Thus the connecting rod 15 forms a lever arm. The connecting rod 15 preferably has a bar shape in cross-section. This permits good reception and transfer of pressure forces.

Furthermore illustrated in FIG. 1 is that a guide part 19 is rigidly joined to the connecting rod 15. The guide part 19 is arranged in a second guide 20. The second guide 20 is for instance a bushing arranged in the rotor housing 6. A bearing 21 is arranged about the guide part 19. The bearing 21 permits the greatest possible friction-free movement of the guide part 19 in the second guide 20. The bearing 21 is preferably a rolling bearing. Since the guide part 19 forms a lever system with the sealing part 14, the bearing 21 is especially also able to transfer to the rotor housing 6 pressure forces that occur according to the lever system. So, as illustrated in FIG. 1, the bearing 21 is moveable both relative to the second guide 20 and relative to the guide part 19. A locking ring 22 is arranged in the rotor housing 6 as a path limit so that the bearing 21 cannot radially exit the rotor housing 6 outward. This makes it possible for the guide part 19 to move about the contoured guide element 8 via the second guide 20 in one 360° rotation, however without a surface of the second guide 20 that transfers the force not being fully utilized. The bearing 21 is advantageously at least as long as the second guide 20.

FIG. 1 illustrates the four pistons 2, 3, 4, 5, each in a different working position. Arrows indicate the direction of rotation. The first piston 2 is just beginning induction, the second piston 3 is situated approximately at the end phase of induction, the third piston 4 is situated at the end of the ignition phase, the fourth piston 5 is situated in the work phase. Corresponding to the respective positions of the pistons 2, 3, 4, 5, the guide part 19 is in a different position within the second guide 20. However, the bearing 21 is dimensioned such that it can project radially inward via the second guide 20. So that the bearing 21 does not strike the contoured guide element 8 for instance when the reciprocating piston engine 1 is idling, a corresponding path limit can be provided. This is for instance present on the guide part 19 itself, for instance by means of a material projection. Alternatively, the second guide 20 can itself have such a path limit. The bearing 21 is preferably also lubricated. The lubricant is supplied using the oil force feed nozzle 58, which supplies all components with sufficient lubricating oil.

Furthermore, it can be seen from FIG. 1 that the contoured guide element has a first segment A, a second segment B, and a third segment C. Each of these is curved. The curvature is designed such that the guide part 19 and the piston 2, 3, 4, 5 can travel linearly along the first guide 9 or the second guide 20. The third segment C is especially at least in part designed such that during the work phase that takes place there the piston 2, 3, 4, 5 remains largely constant in its position within the first guide 9. Thus the combustion chamber 13 does not change during the work phase. This leads to particularly high pressure production in the combustion chamber 13. Via the lever system made of sealing part 14 and guide part 19, this effects particularly high torque transfer to the rotor housing 6. In a fourth segment D the contoured guide element 8 has a shape such that the piston 2, 3, 4, 5 is controlled such that it is possible for the combusted gas to flow out of the combustion chamber 13. For this, the contoured guide element 8 in Segment D has a largely linear area. Furthermore the contoured guide element 8 is designed such that canting of the piston is prevented in both the upper and in the lower dead center. This also results in reduced noise. In addition the lateral pressure of the piston 2, 3, 4, 5 on the cylinder wall 9 is minimized.

FIG. 1 furthermore illustrates a slide element 24 in the gas exchange/sealing system 23. The gas exchange/sealing system 23 is arranged on an exterior cover 23*a* of the rotor housing 6. This causes the gas exchange/sealing system 23 to be rotatably carried with the rotor housing 6. The gas exchange/sealing system 23 has a roller-borne slide element 24 that is fixed eccentrically resiliently on one cylinder end 25 in a slot 26 and lies sealingly against the combustion chamber 13. The slide element 24 has a roller-borne sliding ring 27 that has a first sealing lip 28 and a second sealing lip 29. The sliding ring 27 is adapted to an opposingly arranged surface of a cover housing 30. The sealing lips 28, 29 have a sealing action with the surface of the cover housing 30. If the respective slide element 24 overflowed via an ignition channel 31 in which a spark plug 32 is arranged, a spark is advantageously not triggered until the spark plug 32 is situated within the round first sealing lip 28. The geometry of the ignition channel 31 in the cover housing 30 is preferably designed such that both sealing lips 28, 29 ensure sealing. Thus the slide element 24 acts as a type of safety lock: when the ignition channel 31 is overflowed, if a certain gas volume can still escape via the first sealing lip 28, it is at least captured via the second sealing lip 29. The glide element 24 is itself designed within the slot 26 such that it is not possible for the compressed gas to escape laterally along the slot 26. For this, the slot 26 can have for instance one or more sealing rings. Because of the resilient bearing of the glide element 24, it is in a position to assure the seal when the inlet channel 33 and the outlet channel 34 and the ignition channel 31 are overflowed by corresponding counter-pressure to the surface of the cover housing 30.

Via a corresponding supply and discharge of the inflowing gas, the sealing system 23 ensures the most complete possible filling/evacuation of the combustion chamber. For this, arranged for instance in the cover housing 30 are corresponding control channels 33, 34 along which the combustion chamber is filled and evacuated. The control channels 33, 34 are arranged along the surface opposing the exterior cover 23*a* of the rotor housing 6. This also applies to the gas exchange/sealing system 23. Due to the rotating gas exchange/sealing system 23, the control channels 33, 34 can be relatively long. Preferably the inlet channel 33 is substantially longer than the outlet channel 34. The depth of the control channels 33, 34 and the width of the control channels 33, 34 and the distance between the control channels 33, 34 depends on the size of the reciprocating piston engine.

Figure 2:
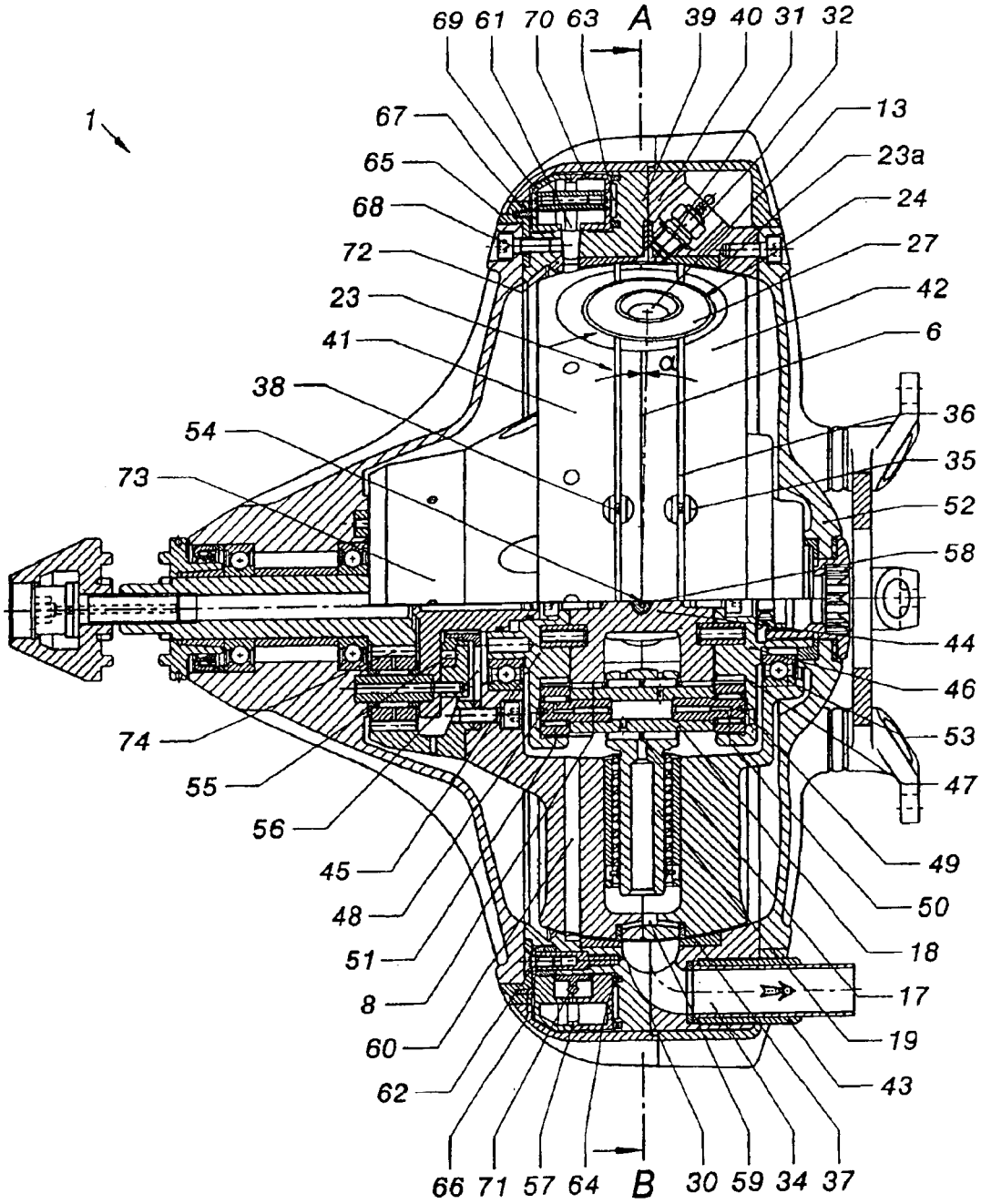
FIG. 2 is a side elevation of the reciprocating piston engine in FIG. 1.

FIG. 2 illustrates a lateral cross-section of the reciprocating piston engine 1 in accordance with FIG. 1. It can be seen that the gas exchange/sealing system 23 has a sealing body 35. Sealing strips 36 are arranged on the sealing bodies 35. The sealing strips 36 are placed under pressure radially using side seal springs 37. The sealing bodies 35 are themselves also able to exert a pressure on the sealing strips 36. The pressure is exerted in the circumferential direction. For this each sealing body 35 carries a leg spring 38. The leg spring 38 thus provides a seal between the sliding ring 27/slide element 24 and the sealing strip 36 adjacent to the slide element 24. The slide element 24 is attached eccentrically, whereby the degree of eccentricity is indicated by the angle $\alpha$. Sealing bodies 35, sealing strips 36, and side seal springs 37 are fixed bilaterally on the exterior cover 23*a* of the rotor housing 6. This makes it possible for the gas exchange channels and the combustion chamber 13 to be completely sealed. This seal is also provided when the rotor 6 passes over the ignition channel 31/the spark plug 32. The gas exchange/sealing system 23 is thus in a position to effect sealing of the combustion space and also sealing during gas exchange. The gas exchange/sealing system 23 also makes it possible for gases to enter and exit via radial apertures. This means that the complete control unit required for gas exchange that is necessary for conventional reciprocating piston engines is not needed, which leads to a substantial reduction in components and to better gas exchange. The reciprocating piston engine 1 illustrated in FIG. 1 works with four cycles (induction, compression, work, exhaust). Thus, in one rotation of the rotor housing 6 two pistons complete one working cycle, for instance pistons 2 and 3.

The reciprocating piston engine 1 has a cover housing 30 that is divided into two parts. A first partial cover housing 39 is joined to a second partial cover housing 40. The rotating rotor housing 6 is arranged in the cover housing 30. The rotor housing 6 is preferably also divided into two parts. A first partial rotor housing 41 is joined to a second partial rotor housing 42. The surface of the cover housing 30 that opposes the exterior cover 23*a* of the rotor housing 6 is curved, in fact, it is concave. With regard to sealing, this spherical design of the surfaces has the advantage that it is easier to obtain a gas-tight seal by means of the gas exchange/sealing system 23, whereby the production tolerances for the gas exchange/sealing system 23 are selected such that the functional spaces are adequately sealed, even despite the freedom of movement the movable parts have. Furthermore, a port 43 is arranged on the cover housing 30. This is the port for the discharge channel 34. The inlet channel 33, which is illustrated only in FIG. 1 and which runs farther in the cover housing 30, is arranged opposing the piston such that gas is supplied eccentrically. In this manner a swirling effect is generated when the gas flows in. The degree of eccentricity is again indicated by the angle $\alpha$.

In addition, the guiding of the connecting rod or the piston along the contoured guide element 8 can be seen in FIG. 2. The contoured guide element 8 is formed by one eccentric disk 44 and by two slots 47 that are congruent in terms of course and that are arranged in mutually opposing cam disks 45, 46. Arranged in the slots 47 is a spacer shaft 18, the ends 48, 49 of which each have one rolling bearing 50. Rollers 51 are allocated to the rolling bearings 50. The rollers 51 and the spacer shaft 18 run along the contoured guide element 8. A needle bearing 17 is arranged on the spacer shaft 18 as connecting rod bearing. It is characterized especially in that it can receive and transfer high bearing forces. This is advantageous for the forces and torques that occur from the sealing part and guide part 19 because of the lever system. The external flank of the slot 47 receives the centrifugal forces of the pistons 2, 3, 4, 5, whereby the curve flank of the eccentric disk 44 receives the gas forces. The roller-borne roller 51 has play against the internal curve flank of the slot 47. Since it performs one rotation about its own axis when rolling on the external curve flank, which has the wrong direction relative to the other curve flank. This play is avoided using the eccentric disk 44, since the two flanks of the slot curve 47 are offset to one another and each flank has its own roller 51 on the spacer shaft 18. The rollers 51 then run in opposing directions of rotation and can be kept permanently in place. The cam disks 45, 46 are arranged opposing the eccentric disk 44, whereby the contoured guide element are bolted to one another congruent and immovable. The cam disks 45, 46 and the eccentric disk 44 are themselves rigidly joined via the housing cover 52 to the cover housing 30. The cam disks 45, 46 and the eccentric disk 44 further support a rotor housing bearing, embodied in this case as a rolling bearing 53.

FIG. 2 illustrates a lubricating system 54. The lubricating system 54 is arranged in the rotor housing 6 and on the cover housing 30 and has an oil pump 55. This is coupled via the driving plate 56 to the rotor housing 6 such that it is driven. The lubricating system 54 is designed independent of the installation position of the reciprocating piston engine, that is, as position-insensitive circulating forced-oil lubrication. The oil is drawn in from the oil ring 57 by the annular gear pump 55, and a pressure relief valve within the pump housing limits the oil pressure and conducts the excess oil back into the intake channel of the pump. From the pressure channel the oil is conducted through the oil filter to the oil force-feed nozzles 58. From there, the lubricating oil travels into the rotor housing 6. For the sake of clarity the pressure relief valve, oil filter, and oil channels are not illustrated in greater detail, even in the individual drawings.

The rotor housing 6 has a plurality of rotably carried lubricating channels 59; these distribute the lubricating oil to the lubrication points. Due to centrifugal forces, the lubricating medium, generally oil, is pressed outward so that preferably the moving components are lubricated from the interior of the rotor housing 6 outward. In this manner it is possible to take advantage of the rotational speed of the reciprocating piston engine in another manner. The oil is returned via the rotor housing 6, which has a plurality of rotatably carried spin channels 60. Centrifugal force presses the lubricating oil out through the spin channels 60. The oil thrown against the opposing oil ring aperture 61, drips down, and travels into the closed part of the oil ring 57. There it is fed back into the lubrication cycle. This process is repeated continuously in order to assure reliable position-insensitive lubrication.

Preferably the oil ring 57 can be rotated 360°, is borne on rollers 62, and is arranged in the first partial cover housing 39. Two sealing rings 64 seal the oil ring 57 to the intake channel 63; these are securely joined to the first partial cover housing 39. Sealing of the side opposing the intake channel 63 is performed by a sealing ring 66, axially movable and provided with a compression spring 65, that is fixed in a slot 67 and that continuously holds the oil ring 57 in place. The first partial cover housing 39 has apertures 68 on the circumference through which the thrown oil travels into the oil ring aperture 61. The oil ring 57 is divided into two parts, whereby a first oil ring housing 69 is joined to a second oil ring end housing 70. However, the oil ring 57 can also comprise one part, for instance a cast part. A float needle valve 71 is arranged in the oil ring 57. The float needle valve 71 and the oil return bores 72 located in the first partial cover housing 39 return the excess oil/leaks to the lubrication cycle.

In order to have adequate oil pressure present when the reciprocating piston engine 1 is started, it is furthermore possible to also have for instance an oil accumulator container present. This is always maintained under pressure when the reciprocating piston engine 1 is being operated. This pressure does not decrease even when the reciprocating pressure engine 1 is turned off. On the contrary, it does not release this pressure until the reciprocating piston engine 1 is to be started. It is also possible to provide an oil pump separate from the rotor housing 6. This can be supplied for instance via an external energy source such as a battery. Another embodiment provides that an oil pump is itself supplied via an external energy source and also via the reciprocating piston engine 1 itself. It is possible to switch from the one energy source to the other energy source at a pre-definable time.

FIG. 2 illustrates an output drive 73 of the reciprocating piston engine 1. The output drive 73 can act directly on a device receiving mechanical energy. Furthermore it is possible to provide a coupling. One further embodiment provides for providing a gear. Preferably the gear is a planetary gear 74. A further advantage is obtained when an infinitely variable speed transmission is employed.

The reciprocating piston engine 1 is then in a position to be operated at a constant speed. The required speed of the device receiving the energy is then adjusted by means of the infinitely variable speed transmission. In this manner it is also possible to change the torque that is taken. In addition to using an infinitely variable speed transmission, it is also possible to use a gear with gear steps.

Figure 3:
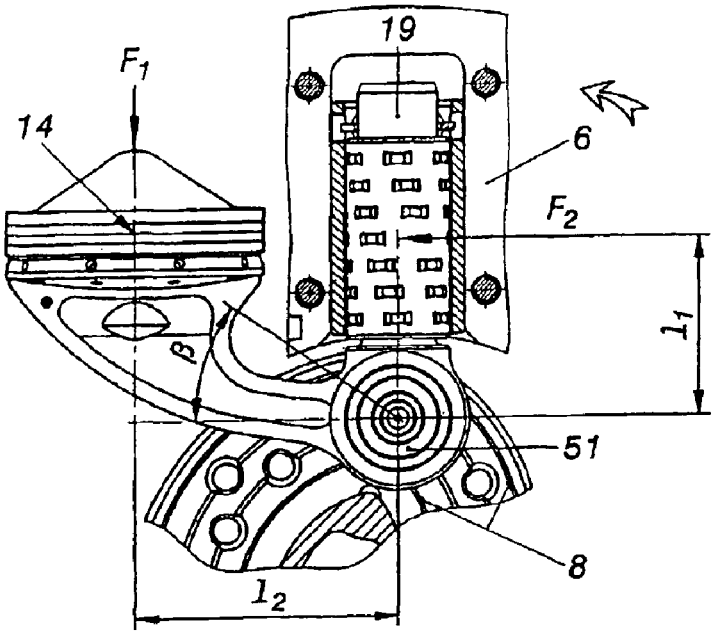
FIG. 3 is a piston, with sealing part and guide part, guided on a contoured guide element.

FIG. 3 illustrates a cut-out of the reciprocating piston engine 1 as illustrated in FIG. 1 and FIG. 2. The lever system made of sealing part 14, guide part 19, and contoured guide element 8 is illustrated. The rollers 51 of the lever system are situated along the contoured guide element 8 in a position in which a high torque is transferred to the rotor housing 6. This transfer is indicated as an example by a triangle of forces with corresponding dimensioning. While for instance a maximum gas force $F_1$, of 2600 N acts on the center of the piston 2, 3, 4, 5, the distance 12 of for instance 38 mm between the piston center axis and the roller center axis at a dynamic effect based on the geometry of the piston 2, 3, 4, 5 leads to a calculated dynamic effect direction that results in an angle β of approximately 34°. With a corresponding design of the guide part 19, transferred to the acting force on the rotor housing 6 results in a force $F_2$ of approx. 3850 N. An average effective length L, of approx. 25 mm is assumed (effective center lever arm). Using this example, it is demonstrated how the force acting on the piston 2, 3, 4, 5 can be used by means of the lever system to increase torque. The increase in force of $F_1$=2600 N to $F_2$=3850 N is only an example in this case. Depending on the modification to the lever paths and the force-transferring surfaces, whether this is on the piston 2, 3, 4, 5 or even on the guide part 19, the torque most suitable for the current application can be adjusted, for instance taking into account stresses occurring in the materials used for the individual components. In addition to the linear guide of the pistons 2, 3, 4, 5 and of the guide part 19 illustrated in FIG. 3, with appropriate adaptation of the contoured guide element 8 it is also possible to provide a curved guide either of the guide part 19 or even of the piston 2, 3, 4, 5 itself or of both in combination with one another. For this, the contoured guide element 8 is appropriately adapted such that in one 360° rotation piston 2, 3, 4, 5 and guide part 19 can run along their guide. It is also possible to be able use the geometry of the piston surface to appropriately adjust the force introduction effect into the lever system. Thus, it is possible to provide a resulting force introduction offset to the piston axis, instead of centrally. For instance, a resulting force introduction into the lever system eccentric to the piston center axis is possible, in particular in the area of an external piston area for obtaining a large lever arm. This is possible for instance using an appropriate surface design of the piston 2, 3, 4, 5. It is furthermore useful when the guide part 19 can extend radially far outward for force transfer. This improves the torque effect. In particular it makes it possible that, using the radial extension of the guide part 19, the integral of the surface force on the guide part 19 is designed such that it either runs in a uniformly increasing function or in an exponential function.

Figure 4:
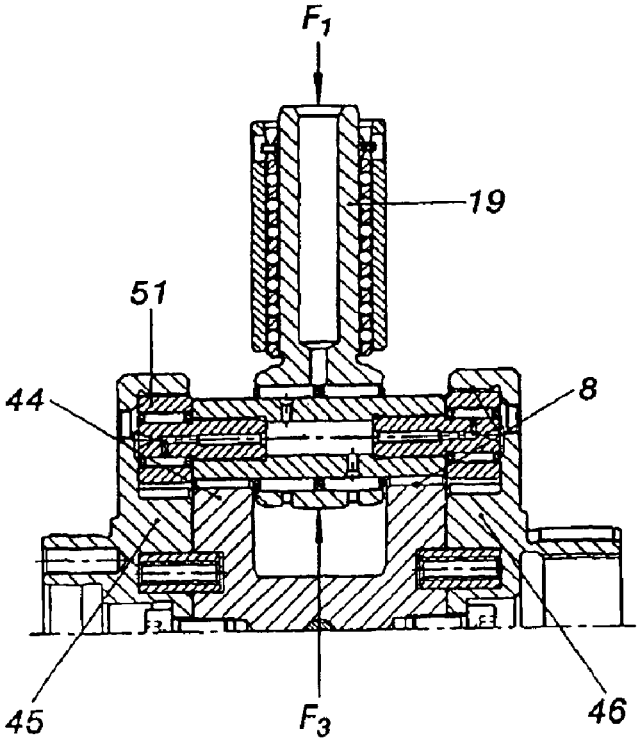
FIG. 4 is a side elevation of the contoured guide element and one guide of the piston along the contoured guide element.

FIG. 4 illustrates a top view of the cut-out from FIG. 3. The rollers 51 that are adjacent to the contoured guide element 8 are pressed thereagainst via a centrifugal force $F_3$ of for instance 800 N. The centrifugal force depends on the rotational speed. The first cam disk 45 and the second cam disk 46 are designed such that they can receive this centrifugal force. In the work cycle the rollers 51 that are adjacent to the contoured guide element 8 of the eccentric disk 44 are pressed thereagainst using a gas force $F_1$ of for instance 2600 N. The eccentric disk 44 is designed such that it can correspondingly receive this gas force. If the lever system has appropriate components, it can be adapted to a corresponding reciprocating piston engine 1 with other dimensions. Preferably the guide part 19 is one piece, whereby it can also be bolted to the lever system as a bushing element. In particular this permits a modular construction system to be used. The modular construction system contains for instance pistons, connecting rod, bearing, rollers, eccentric disk, cam disks, etc.

Figure 5:
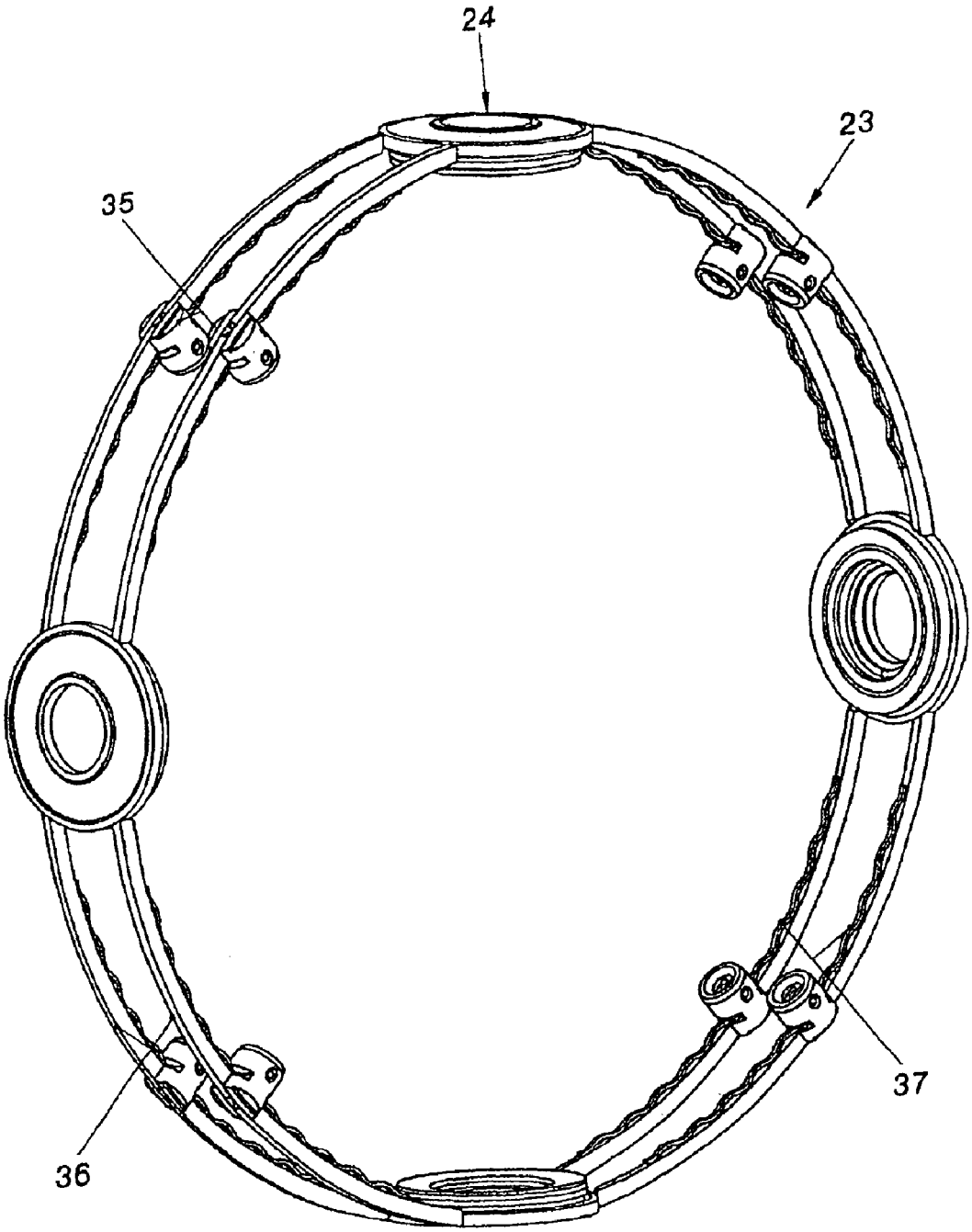
FIG. 5 is a gas exchange/sealing system for the reciprocating piston engine in FIG. 2.

FIG. 5 illustrates the gas exchange/sealing system 23 from FIG. 2. As illustrated in FIG. 5, the gas exchange/sealing system 23 has four slide elements 24, eight sealing bodies 35, sixteen sealing strips 36, and sixteen side seal springs 37. Sealing strips 36 are sealingly adapted to the sealing bodies 35 and to the slide elements 24. The side seal springs 37 exert radial pressure on the sealing bodies 35 and sealing strips 36.

Figure 6:
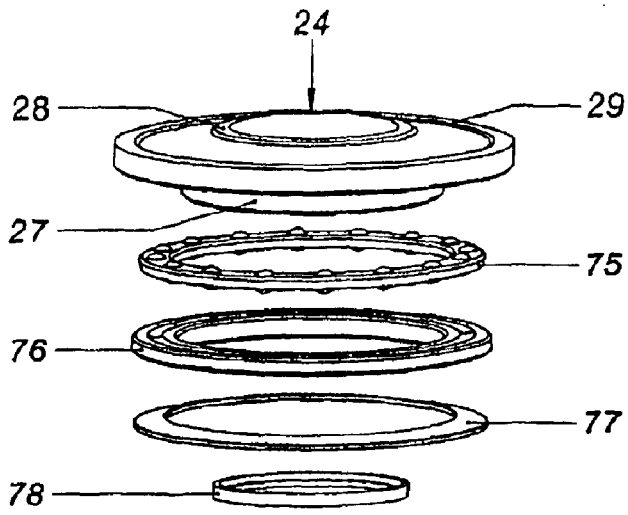
FIG. 6 is a rotor seal of the gas exchange/sealing system in FIG. 5.

FIG. 6 is an exploded illustration of a slide element 24 from FIG. 5. The slide element 24 has a roller-borne sliding ring 27, upon which are arranged a first sealing lip 28 and a second sealing lip 29. The sliding ring 27 is fixed together with a ball cage 75, a race 76, and a cup spring 77 as a radial pressure device for the slide element 24 in a slot 26 situated on the cylinder. The interior sealing ring 78 seals the slide element 24 against the combustion chamber 13. FIG. 1 illustrates how the slide element 24 is fixed and how the slide element 24 is sealed from the combustion chamber 13.

Figure 7:
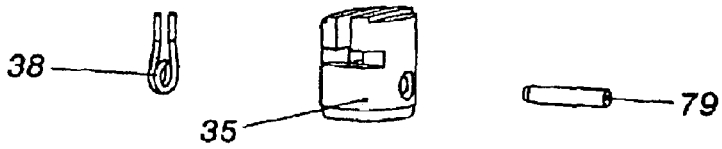
FIG. 7 is a sealing body of the gas exchange/sealing system in FIG. 5.

FIG. 7 illustrates a sealing body 35 from FIG. 5 in greater detail. The sealing body 35 contains a leg spring 38 that is fixed via a cylinder pin 79. A pressure is exerted via the leg spring 38 on the sealing strips 36 to be arranged in the sealing body 35. The leg spring 38 presses the sealing strips 36 outward so that when installed a dynamic effect in the slot presses the sealing strips 36 onto the slide element 24 in the circumferential direction. This also holds the sealing strips 36 in their position. In this manner the seal is created for the gas exchange. In addition, this permits the components to be sealed that are situated in the interior of the rotor housing 6. The sealing bodies 35 can comprise for instance silicon nitrite.

Figure 8:
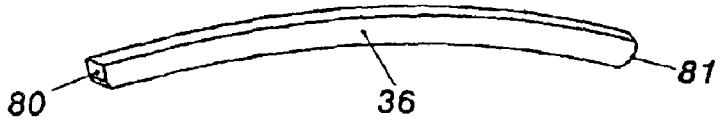
FIG. 8 is a sealing strip of the gas exchange/sealing system in FIG. 5.

FIG. 8 illustrates a sealing strip 36. It has a first end 80 and a second end 81. The first end 80 is adapted to the slide element 24 corresponding to the seal. The second end 81 is also designed such that it receives pressure from the leg spring 38 and transfers it into the sealing strip 36 to the first end 80 in particular uniformly. The sealing strip 36 can itself also comprise silicon nitrite.

Figure 9:
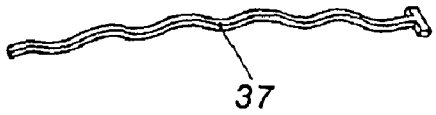
FIG. 9 is a side seal spring of the gas exchange/sealing system in FIG. 5.

FIG. 9 illustrates one option for exerting radial pressure on a sealing strip 36. This radial pressure device takes the form of a side seal spring 37. The waves mean that the side seal spring 37 permits a plurality of force introduction points to be applied to the sealing strip 36 distributed across its circumference. This leads to uniform exertion of pressure in the radial direction and thus to a particularly effective seal.

Figure 10:
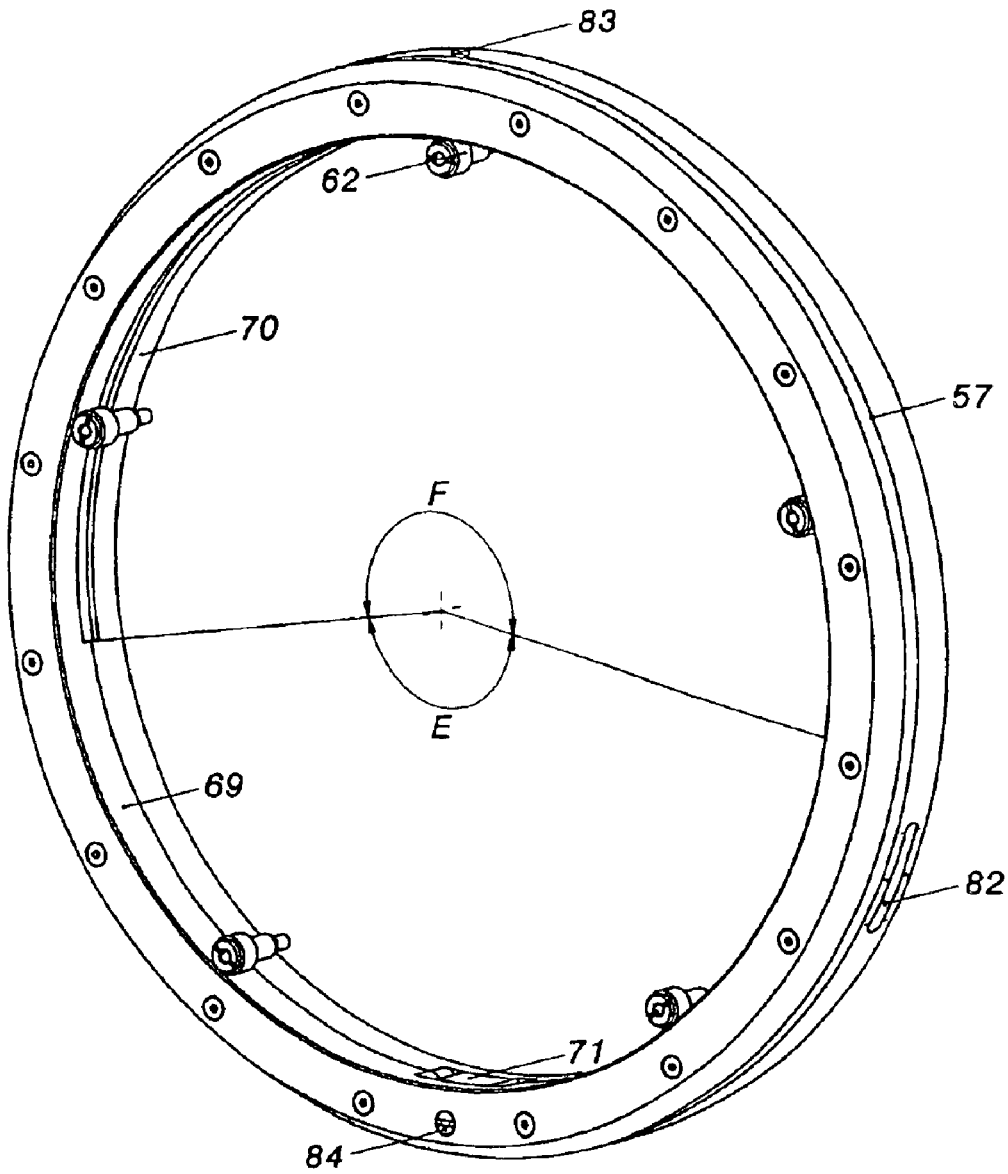
FIG. 10 is an oil ring in the lubricating system in FIG. 2.

FIG. 10 illustrates an oil ring 57 of the lubricating system 54. The oil ring 57 has two parts. A first oil ring housing 69 is connected to a second oil ring end housing 70. The oil ring 57 has a first segment E and a second segment F. These are each radially allocated to the axis of rotation of the oil ring 57. The segment E is the closed part, the segment F is the open part of the oil ring 57. The volume content of the closed part in the segment E of the oil ring should be less than but nor more than equal to the volume content of half the oil ring aperture of the segment F. This avoids unnecessary excess oil and minimizes oil and hydraulic losses. Oil return occurs via the float needle valve 71, which is arranged in the oil ring 57 and in the oil return bores 72 in the first partial cover housing 39. The oil ring 57 is preferably borne on rollers 62 so that it can rotate more easily 360° about its own axis. For controlling the oil level, inspection windows 82 that have markings to be able to measure the oil level are attached to the oil ring 57 and to the oil ring cover. The oil level itself is regulated by the oil fill plug 83 and the oil drain plug 84, which are arranged in the oil ring 57.

Figure 11:
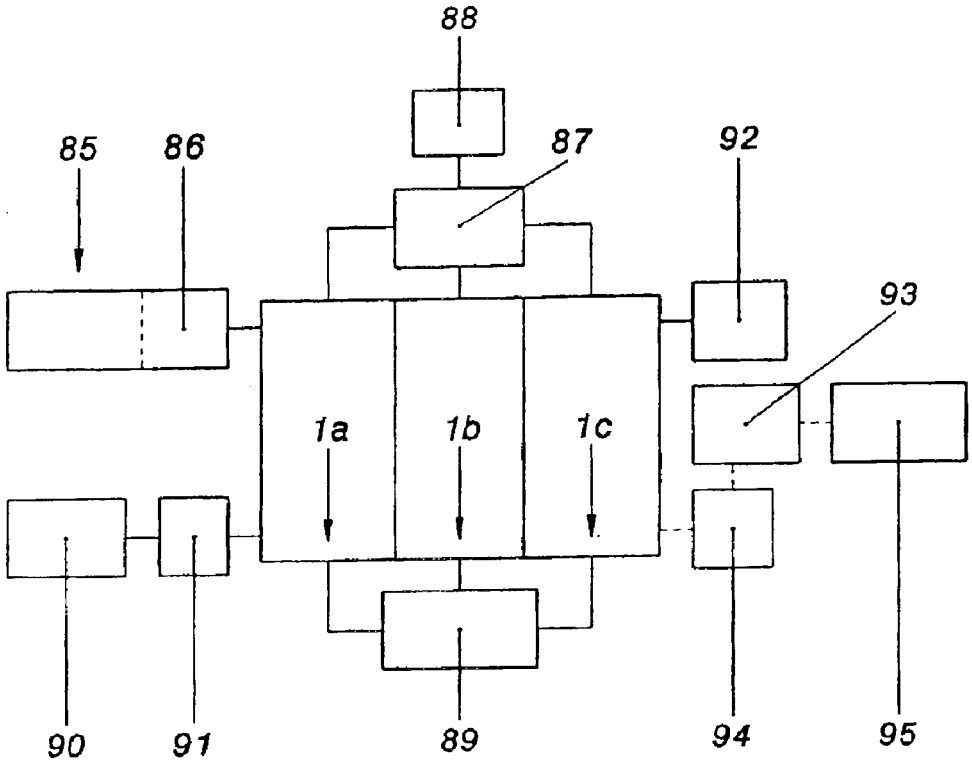
FIG. 11 is a schematic view of a multiple arrangement of reciprocating piston engines.

FIG. 11 illustrates a multiple arrangement of reciprocal piston engines 1*a*, 1*b*, 1*c*. These are coupled to one another. Furthermore, this multiple arrangement has a supercharger device 85. This can for instance contain a charge-air cooling 86 that is usefully provided in an exhaust gas supercharger. The reciprocating piston engines are supplied lubricating agent via a lubricating device 87. The lubricating device is preferably coupled to the reciprocating piston engines 1*a*, 1*b*, 1*c* such that it is driven by them. Then a position-insensitive forced feed lubrication is preferably used for the lubricating device 87. There is also the option of providing an external lubricating device 87. This is supplied for instance via an external energy source 88, for instance a battery. Furthermore an electronics unit 89 is provided in connection with the reciprocating piston engines 1*a*, 1*b*, 1*c*. The electronics unit 89 controls or regulates them. For instance one or a plurality of these reciprocating piston engines 1*a*, 1*b*, 1*c* can be turned on or off. The electronics unit 89 also controls ignition. For instance the ignition can also be turned on and off. Furthermore, the electronics unit 89 regulates or controls the fuel quantity that is supplied via a fuel reservoir container 90 through a corresponding mixture preparation 91 or the like to the reciprocating piston engines 1*a*, 1*b*, 1*c*. An exhaust treatment apparatus 92 can also be connected to the reciprocating piston engines 1*a*, 1*b*, 1*c*. This is for instance a catalytic converter, an exhaust gas return, etc. This is preferably also controlled or regulated by means of the electronics unit 89, via the fuel supply.

A consumer 93 can be connected to the reciprocating piston engines 1*a*, 1*b*, 1*c*; it converts energy that originates in the engines. An intermediate member 94 is preferably also arranged between the consumer 93 and the reciprocating piston engines 1*a*, 11*b*, 1*c*. The intermediate member is for instance a coupling, a gear, or something else.

The reciprocating piston engine 1*a*, 1*b*, 1*c* can also be employed in an interconnection with one or a plurality of other energy supply devices 95. This can be a fuel cell, a battery, or the like. The energy supply device 95 also supplies the consumer 93 with energy. The energy supply device 95 can be turned on and off via the electronics unit 89, just like one or more of the reciprocating piston engines 1*a*, 1*b*, 1*c*. The reciprocating piston engines 1*a*, 1*b*, 1*c* can for instance act as the basic supplier. The energy supply device 95 is only turned on as needed. The reverse is also possible. The two can also supplement one another.

The reciprocating piston engine as described above is preferably operated either alone or with other units. For instance, the reciprocating piston engine can be used for the energy generator in a stationary application. For instance, this is possible for block heating and power stations. Other stationary applications are small energy suppliers or transportable units such as emergency generating sets. Furthermore, because of its construction, the reciprocating piston engine offers the opportunity to be used for commercial motor vehicles, passenger cars, or even small equipment such as lawnmowers, saws, and other such equipment. The reciprocating piston engine can also be used in other transportation means such as motorcycles and mopeds.

Fuel consumption can be reduced with this new reciprocating piston engine. It is also possible, now and in the future, to satisfy the worldwide known exhaust gas regulations with it. The reciprocating piston engine provides a very high torque at very low numbers of revolutions. Therefore very good driving performance is possible. In particular the reciprocating piston engine can be used for vehicles that are operated with hydrogen. The structure of the reciprocating piston engine results as a matter of principle in a reduction in resultant noise emissions. This makes it possible to use the reciprocating piston engine even in noise-sensitive areas. The construction of a reciprocating piston engine in a modular system with many identical components makes it possible to reduce production costs. Because of the work principle, complex components in conventional reciprocating piston engines such as for instance a valve train are not needed. Despite this they are reliable. There are few wear parts because of the fundamentally different construction compared to conventional reciprocating piston engines. This makes maintenance easier. In addition, this makes it easier to exchange the components at less cost. The reciprocating piston engine is designed such that both sealing and appropriate lubrication are assured despite unavoidable heat expansion and any corresponding deformation, even for components under stress, and functionality is assured even with progressive wear.

The functioning principle permits many options for operating the reciprocating piston engine. For instance, it is advantageous to undertake combustion of the fuel at the same cylinder volume in the work cycle. The reciprocating piston engine is also designed such that in the work cycle no inertial forces act against the gas forces. The advantageous 4 cycle method with separate gas exchange provides little loss compared to conventional piston engines. The design of the piston with sealing part and guide part as lever system makes possible high force transmission and high torque. The combustion space can be kept compact, which again requires only a small combustion space surface. What this permits is that the reciprocating piston engine can be liquid-cooled but also air-cooled. Since the point of application of the piston guide lies far outside of the rotor point of rotation, great torque is generated using the gas force in conjunction with the lever arm in the cycle. Furthermore, advantageously only one spark plug and one carburetor or injection nozzle is needed on the reciprocating piston engine. This reduces the number of components that have to be maintained and that are also subject to wear. Combustion space sealing occurs by means of a sliding ring that in particular can be rotating. The rotation provides the fuel/air mixture a swirl that is advantageous for combustion. The seal between the cover housing and the rotor housing occurs using the fixed sealing elements in a secure manner. Using an appropriate gear, for instance a planetary gear, it is possible to increase the number of revolutions of the reciprocating piston engine for the consumer. Another advantage and thus a particular flexibility for the employability of the reciprocating piston engine is a position-insensitive oil supply. The reciprocating piston engine can be used in all conceivable installation positions. Despite this, the oil supply is always assured. Overall, the separation of inlet and discharge outlet channels also enables adequate cooling of all stationary and moving components. This is further supported by the separation of combustion chambers from other movable parts of the engine. The reciprocating piston engine thus ensures high output and certain function with low susceptibility to faults.

List of reference symbols used

1 Reciprocating piston engine

1*a* Reciprocating piston engine

1*b* Reciprocating piston engine

1*c* Reciprocating piston engine
2 Piston
3 Piston
4 Piston
5 Piston
6 Rotor housing
7 Space
8 Contoured guide element
9 Guide
10 Top
11 Piston ring
12 Piston ring
13 Combustion chamber
14 Sealing part
15 Connecting rod
16 Aperture/connecting rod
17 Connecting rod bearing
18 Spacer shaft
19 Guide part
20 Second guide
21 Bearing
22 Locking ring
23 Gas exchange/sealing system
23*a* Exterior cover
24 Slide element
25 Cylinder end
26 Slot/cylinder
27 Sliding ring
28 First sealing lip
29 Second sealing lip
30 Cover housing
31 Ignition channel
32 Spark plug
33 Inlet channel
34 Discharge channel
35 Sealing body
36 Sealing strip
37 Side seal spring
38 Leg spring
39 First partial cover housing
40 Second partial cover housing
41 First partial rotor housing
42 Second partial rotor housing
43 Port
44 Eccentric disk
45 Cam disk
46 Cam disk
47 Slot/contour
48 End/spacer shaft
49 End/spacer shaft
50 Rolling bearing
51 Rollers/spacer shaft
52 housing cover
53 rolling bearing
54 lubricating system
55 oil pump
56 driving plate
57 oil ring
58 oil force-feed nozzles
59 lubricating channels
60 spin channels
61 oil ring aperture
62 rollers/oil ring
63 Intake channel
64 two sealing rings
65 compression spring
66 sealing ring
67 slot/sealing ring
68 apertures/partial cover housing
69 first oil ring housing
70 second oil ring end housing
71 float needle valve
72 oil return bores
73 output drive
74 planetary gear
75 ball cage
76 race
77 cup spring
78 interior sealing ring
79 cylinder pin
80 first end/sealing strip
81 second end/sealing strip
82 inspection windows
83 oil fill plug
84 oil drain plug
85 supercharger device
86 charge-air cooling
87 lubricating device
88 energy source
89 electronics unit
90 fuel reservoir container
91 mixture preparation unit
92 exhaust treatment apparatus
93 consumer
94 intermediate member
95 energy supply device

What is claimed is:

1. A reciprocating piston engine, comprising:

a rotor housing, for transferring an acting torque to an output drive of said reciprocating piston engine;

a contoured guide element, having a closed, curvilinearly contoured shape, contained in said rotor housing, such that said rotor housing is rotatable around said contoured guide element;

at least one compression unit, in said rotor housing, each compression unit comprising:

a piston; and a cylinder;

such that a line of action of said piston in said cylinder is a straight line lying in a plane perpendicular to an axis of rotation of said rotor housing, and is eccentric to said axis of rotation of said rotor housing;

a connecting rod, rigidly coupled to said piston, said connecting rod being movable along a path determined by said curvilinearly contoured shape of said contoured guide element to transfer controlled movement specified by said contoured guide element to said piston; and a guide part, joined to said connecting rod, and movable along a separate guide in said rotor housing, whereby said connecting rod, said piston, and said guide part each perform a single stroke along a straight line in said rotor housing.

2. The reciprocating piston engine according to claim 1, further comprising a connecting rod bearing, movable along a path determined by said curvilinearly contoured shape of said contoured guide element, said connecting rod bearing being positioned at a point of connection between said connecting rod and said guide part.

3. The reciprocating piston engine according to claim 1, wherein said separate guide for said guide part is linear and has a longitudinal axis which intersects said axis of rotation of said rotor housing.

4. The reciprocating piston engine according to claim 3, wherein said linear separate guide for said guide part is a bushing, and further comprising a rolling bearing surrounding said guide part, and displaceable in a longitudinal direction of said bushing.

5. The reciprocating piston engine according to claim 4, wherein said rolling bearing is movable relative to said guide part and said bushing; and further comprising a path limiting element for preventing said rolling bearing from exiting outward in a direction of said longitudinal axis of said guide part.

6. The reciprocating piston engine according to claim 5, wherein said path limiting element is a locking ring affixed to said rotor housing.

7. The reciprocating piston engine according to claim 4, wherein said rolling bearing has a length that is at least as long as a length of said bushing.

8. The reciprocating piston engine according to claim 1, wherein there are four compression units, positioned such that said piston of each said compression unit has a line of action that is offset to one another by 90° in a plane perpendicular to said axis of rotation of said rotor housing.

9. The reciprocating piston engine according to claim 1, wherein said closed curvilinear shape of said contoured guide element is such that each said compression unit completes at least one work cycle for each complete rotation of said rotor housing.

10. The reciprocating piston engine according to claim 1, wherein said closed curvilinear shape of said contoured guide element is such that during a work cycle of each said compression unit, a size of a combustion chamber for each said compression unit is defined by a farthest extent of movement of each said piston and is substantially isochoric.

11. The reciprocating piston engine according to claim 1, wherein said contoured guide element comprises an eccentric disk, and two congruent slots in mutually opposing cam disks; and said reciprocating piston engine further comprises a spacer shaft, having said connecting rod bearing mounted thereon, and having end-side rollers held in place in said slots.

12. The reciprocating piston engine according to claim 1, wherein said rotor housing has an exterior cover, on which a gas exchange/sealing system that is at least partially sealingly adjacent to a cover housing of said reciprocating piston engine is mounted.

13. The reciprocating piston engine according to claim 12, wherein said gas exchange/sealing system includes a pressurized, radially movable, and rotatably borne slide element.

14. The reciprocating piston engine according to claim 13, wherein said gas exchange/sealing system includes sealing strips that are sealingly attached to said slide element and to a sealing body.

15. The reciprocating piston engine according to claim 1, further comprising a position-insensitive lubricating system, with a roller-borne oil ring that is rotatable 360 about an axis of said oil ring.

* * * * *